US009962711B2

(12) United States Patent
Chen et al.

(10) Patent No.: US 9,962,711 B2
(45) Date of Patent: May 8, 2018

(54) ELECTROSTATIC AIR CLEANER

(71) Applicant: INDUSTRIAL TECHNOLOGY RESEARCH INSTITUTE, Hsin-Chu (TW)

(72) Inventors: Chien-Chih Chen, Hsin-Chu (TW); Chih-Chen Chang, Banciao (TW); Chen-Der Tsai, Hsinchu County (TW); Chih-Yung Huang, Taichung County (TW)

(73) Assignee: INDUSTRIAL TECHNOLOGY RESEARCH INSTITUTE, Hsin-Chu (TW)

( * ) Notice: Subject to any disclaimer, the term of this patent is extended or adjusted under 35 U.S.C. 154(b) by 136 days.

(21) Appl. No.: 14/953,547

(22) Filed: Nov. 30, 2015

(65) Prior Publication Data

US 2016/0158766 A1 Jun. 9, 2016

(30) Foreign Application Priority Data

Dec. 4, 2014 (TW) ..... 103142171 A
Apr. 9, 2015 (TW) ..... 104111497 A

(51) Int. Cl.
*B03C 3/47* (2006.01)
*B03C 3/49* (2006.01)
(Continued)

(52) U.S. Cl.
CPC ..... *B03C 3/47* (2013.01); *B03C 3/12* (2013.01); *B03C 3/366* (2013.01); *B03C 3/368* (2013.01);
(Continued)

(58) Field of Classification Search
CPC combination set(s) only.
See application file for complete search history.

(56) References Cited

U.S. PATENT DOCUMENTS 4,029,485 A * 6/1977 Siwersson ..... B03C 3/10 55/340
5,055,118 A * 10/1991 Nagoshi ..... B03C 3/60 96/77
(Continued)

FOREIGN PATENT DOCUMENTS

CN 1357952 A 7/2002
CN 1380143 A 11/2002
(Continued)

OTHER PUBLICATIONS

Intellectual Property Office, Ministry of Economic Affairs, R.O.C., "Office Action", dated Jul. 26, 2016, Taiwan.
(Continued)

*Primary Examiner* — Robert A Hopkins
*Assistant Examiner* — Sonji Turner
(74) *Attorney, Agent, or Firm* — Locke Lord LLP; Tim Tingkang Xia, Esq.

(57) ABSTRACT

An electrostatic air cleaner comprises a main body, a corona discharged module, a collector module and a fan. The main body has an airflow passage for disposing the corona discharged module, the collector module and the fan. The fan is used for drawing an air stream into the airflow passage. The corona discharged module is used for discharging particles in the air stream. The charged particles are then captured by the collector module.

38 Claims, 16 Drawing Sheets

(51) Int. Cl.
*B03C 3/41* (2006.01)
*B03C 3/12* (2006.01)
*B03C 3/36* (2006.01)

(52) U.S. Cl.
CPC ..... *B03C 3/41* (2013.01); *B03C 3/49* (2013.01); *B03C 2201/06* (2013.01); *B03C 2201/10* (2013.01)

(56) References Cited

U.S. PATENT DOCUMENTS

| | | | | |
|---|---|---|---|---|
| 5,215,558 | A | 6/1993 | Moon | |
| 6,350,417 | B1 | 2/2002 | Lau et al. | |
| 6,962,620 | B2 * | 11/2005 | Chang | B03C 3/32 96/60 |
| 7,291,207 | B2 | 11/2007 | Taylor et al. | |
| 7,897,118 | B2 | 3/2011 | Taylor et al. | |
| 8,268,058 | B2 * | 9/2012 | Wu | B03C 3/09 95/78 |
| 8,894,745 | B2 * | 11/2014 | Dunn | B03C 3/12 95/70 |
| 9,073,062 | B2 * | 7/2015 | Dunn | B03C 3/47 |
| 2010/0033891 | A1 * | 2/2010 | Orihara | B08B 1/00 361/231 |
| 2011/0113963 | A1 | 5/2011 | Wu et al. | |
| 2013/0036906 | A1 * | 2/2013 | Dunn | B03C 3/12 95/70 |
| 2014/0283686 | A1 * | 9/2014 | Dunn | B03C 3/47 95/78 |

FOREIGN PATENT DOCUMENTS

| | | | | |
|---|---|---|---|---|
| CN | 201802647 | U | 4/2011 | |
| CN | 102039222 | A | 5/2011 | |
| CN | 102668285 | A | 9/2012 | |
| CN | 204620209 | U | 9/2015 | |
| EP | 0239865 | A1 * | 10/1987 | B03C 3/06 |
| JP | H04504975 | A | 9/1992 | |
| JP | 2005046761 | A | 2/2005 | |
| KR | 20040046451 | A * | 6/2004 | |
| KR | 1020040046451 | A | 6/2004 | |
| TW | 398999 | B | 7/2000 | |
| TW | 532231 | U | 5/2003 | |
| TW | I220654 | B | 9/2004 | |
| TW | I230630 | B | 4/2005 | |
| TW | I243713 | B | 11/2005 | |
| TW | I301535 | B | 10/2008 | |
| TW | M350940 | U | 2/2009 | |
| TW | I376488 | B | 11/2012 | |
| TW | M460167 | U | 8/2013 | |
| TW | M472173 | U | 2/2014 | |
| WO | 2009098356 | A1 | 8/2009 | |
| WO | WO 2009098356 | A1 * | 8/2009 | B03C 3/47 |
| WO | 2013141549 | A1 | 9/2013 | |

OTHER PUBLICATIONS

Seong Jin Yun et al., A novel polymer-arrayed electrostatic precipitator with electrical resistance material for the removal of fine particles, Journal of Aerosol Science, vol. 57, Mar. 2013, pp. 88-95.
Chih-Wei Lin et al., From electrostatic precipitation to nanoparticle generation, Journal of Aerosol Science, vol. 51, Sep. 2012, pp. 57-65.
Okubo, M. et al., Electric Air Cleaner Composed of Nonthermal Plasma Reactor and Electrostatic Precipitator, IEEE Transactions on Industry Applications, 2001, 1505-1511, vol. 37, No. 5.
Kimberly J. Boelter et al., Ozone Generation by Indoor, Electrostatic Air Cleaners, Aerosol Science and Technology, 1997, 27:689-708.
Kim, H.-J. et al., Submicrometer particle removal indoors by a novel electrostatic precipitator with high clean air delivery rate, low ozone emissions, and carbon fiber ionizer, Indoor Air, 2013, 23:369-378.
Hacker, D. W, et al., Use of air-cleaning devices to create airborne particle-free spaces intended to alleviate allergic rhinitis and asthma during sleep, Indoor Air, 2006.
Botvinnik, I. et al., High-Efficiency Portable Electrostatic Air Cleaner With Insulated Electrodes, IEEE Transactions on Industry Applications, 2008, 512-516, vol. 44, No. 2.
State Intellectual Property Office of the P. R. C, "Office Action", dated Apr. 21, 2017, China.

* cited by examiner

ELECTROSTATIC AIR CLEANER

CROSS REFERENCE TO RELATED APPLICATION

The present application is based on, and claims priority from, Taiwan Application Serial Number 103142171, filed on Dec. 4, 2014; and Taiwan Application Serial Number 104111497, filed on Apr. 9, 2015, the disclosure of which is hereby incorporated by reference herein in its entirety.

TECHNICAL FIELD

The present disclosure relates in general to an electrostatic air cleaner, and more particularly to an electrostatic air cleaner for efficiently cleaning particles in the air.

BACKGROUND

In the art, wire-plate type Electrostatic Precipitators (ESPs) have been widely used for industrial air purification applications. Advantages of the ESPs include high efficiency for fine particles removal, no filter consumption and low pressure drop. However, the wire-plate type ESP is hardly applied as a domestic air cleaner due to its volume, mobility and maintenance.

Typically, a conventional electrostatic air cleaner usually includes a housing with an air inlet and an air outlet and a fan for drawing an air stream into the housing. The air stream passes an ionizing wire so as to cause particles in the air stream to be electrically charged. The charged particles are then attracted and thus adhere to collection plates so as to purify the air before leaving the housing.

Nevertheless, in the art, the desire to obtain an electrostatic air cleaner that is compact, portable, more efficient in collecting particles from the air, and easy to be cleaned is always there.

SUMMARY

An object of the present disclosure is to provide an electrostatic air cleaner which is easy to manufacture and can be operated more efficiently.

Another object of this present disclosure is to provide an electrostatic air cleaner which is easy to scale up and down, carry and maintain. The modular structures applied in this disclosure allow various combinations and thus can provide a great variety of compatible units.

In this disclosure, the electrostatic air cleaner comprises a main body, a corona discharged module, a collector module and a fan. The main body has an airflow passage for disposing the corona discharged module, the collector module and the fan. The corona discharged module is used for producing point discharges with first polarity. The fan is used for drawing an air stream into the airflow passage. Particles in the air stream would be electrically charged by an electric field of the corona discharged module when the air stream pass through the corona discharged module, and then down the stream the collector module can thus capture the particles in the air stream.

By providing the electrostatic air cleaner in accordance with this disclosure, particles in the air which is drawn into the main body can be removed from the air stream before the air is discharged out of the cleaner.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
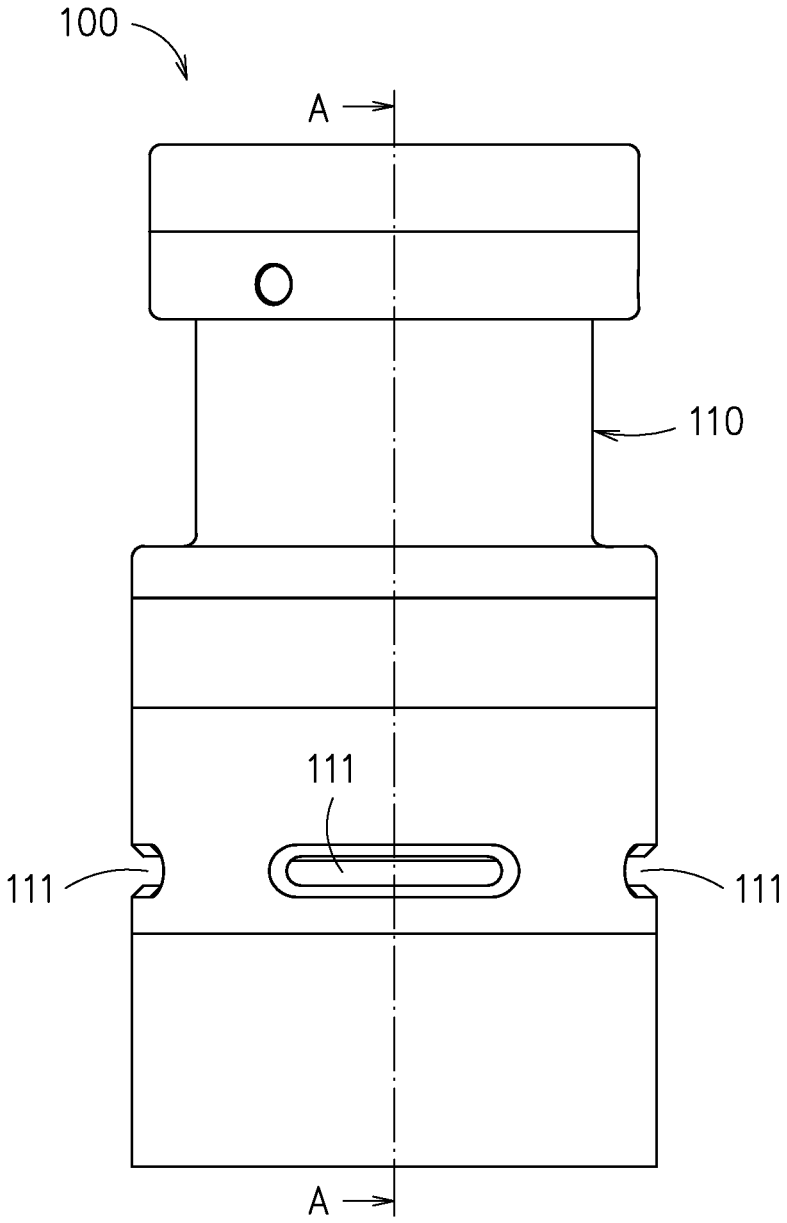
FIG. 1 is a schematic diagram showing an assembly of an electrostatic air cleaner according to an embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
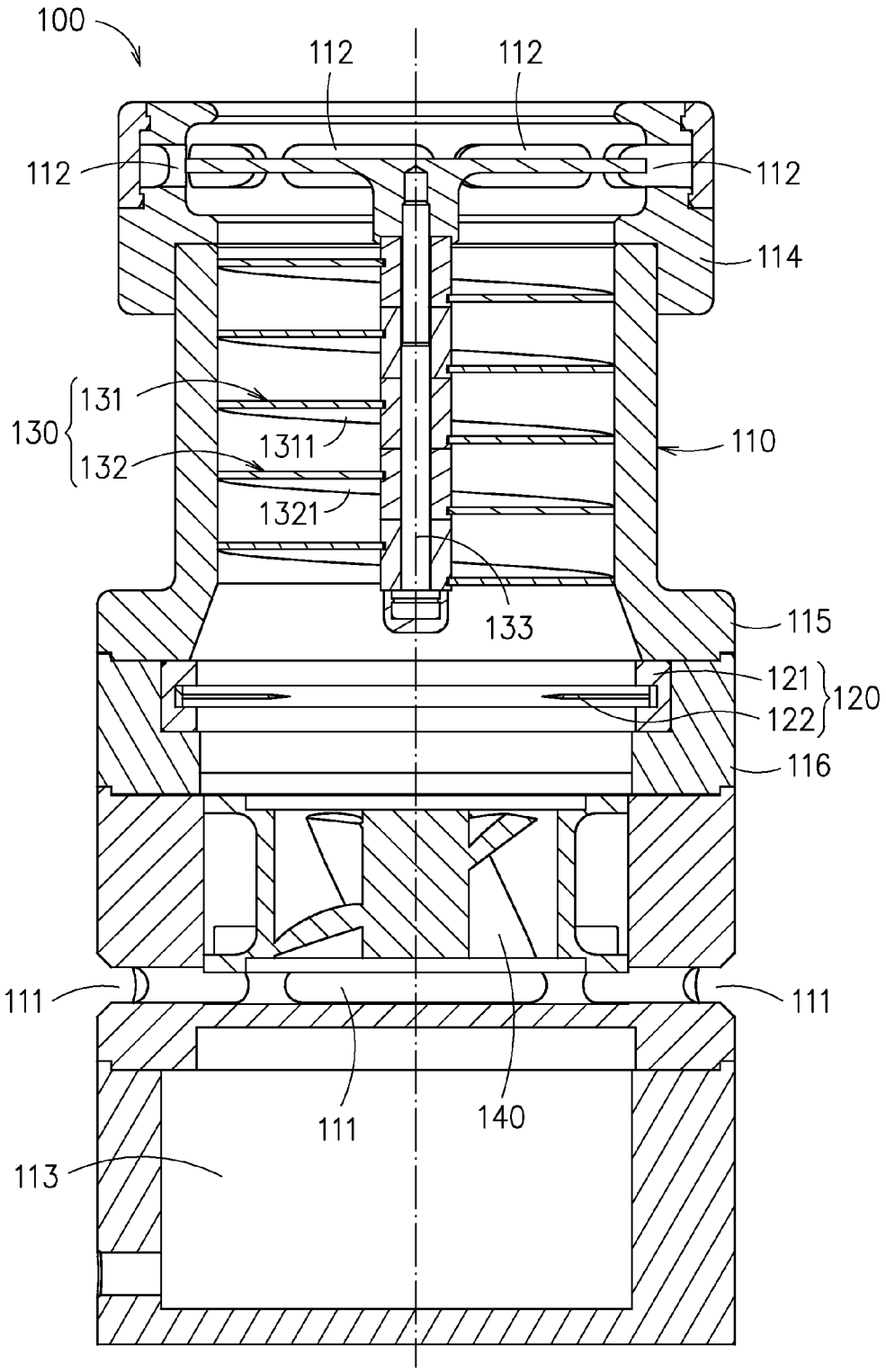
FIG. 2 is a schematic cross-sectional view of FIG. 1 along line A-A.
Figure 3:
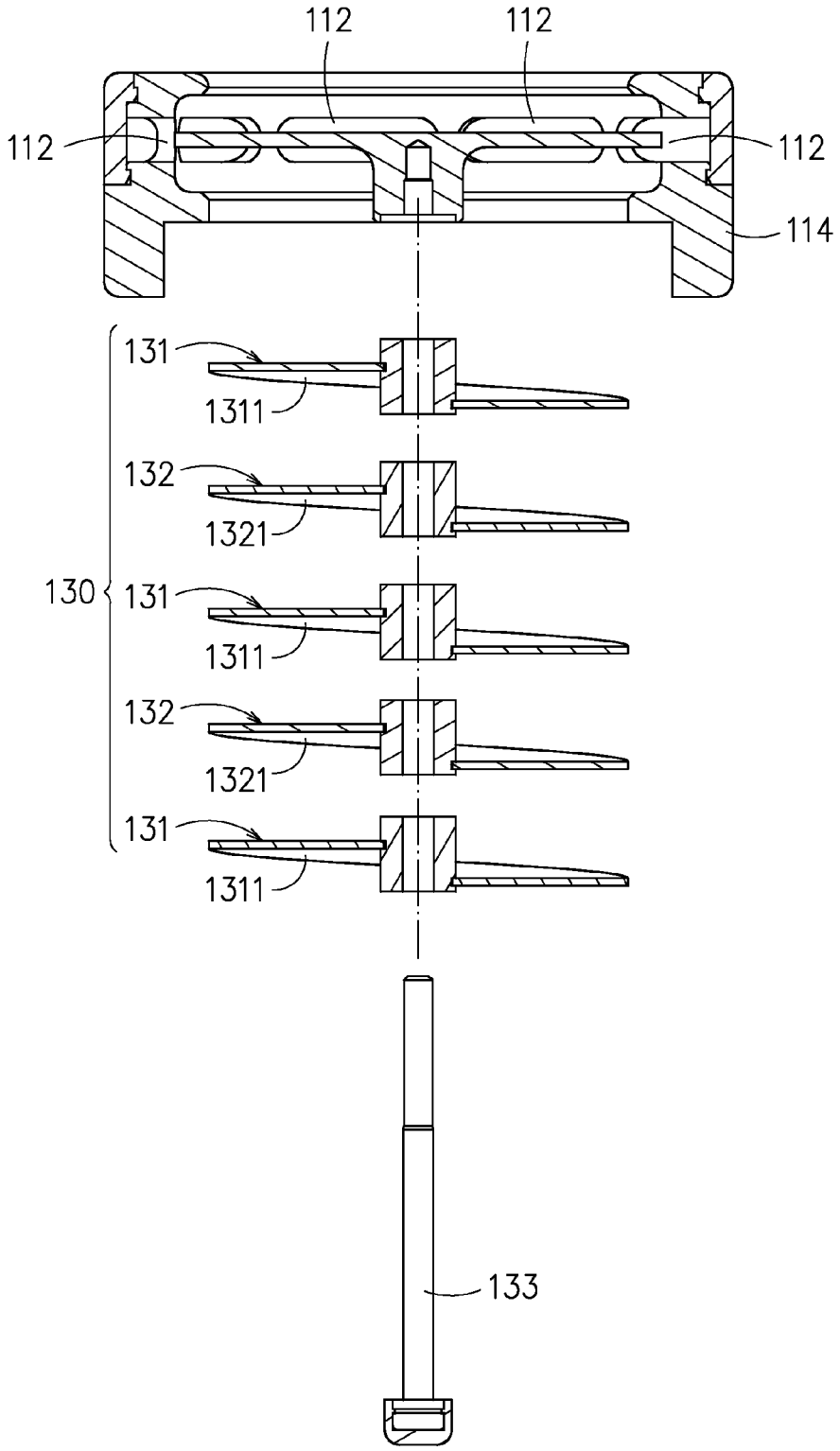
FIG. 3 is an exploded view showing an upper portion of FIG. 2.

Referring to FIG. 1 and FIG. 2, schematic views of one embodiment of the electrostatic air cleaner according to the present disclosure are shown. In this embodiment, the electrostatic air cleaner 100 comprises a main body 110, a corona discharged module 120, a collector module 130, and a fan 140. The main body 110 is shaped as a hollow cylinder having an inlet 111 and an outlet 112. In this embodiment, the outlet 112 is disposed at an upper section of the main body 110, and the inlet 111 is disposed beneath the outlet 112. The inlet 111 and the outlet 112 are communicative in space by forming an air flow passage inside the main body 110. The corona discharged module 120, the collector module 130 and the fan 140 are disposed in the air flow passage. The main body 110 can further include a space 113 for disposing a driving element such as a circuit board or a driving motor for activating the corona discharged module 120, the collector module 130 and the fan 140. In the present embodiment, the fan 140 is disposed inside the main body 110 at a position thereof near the inlet 111.

Figure 4:
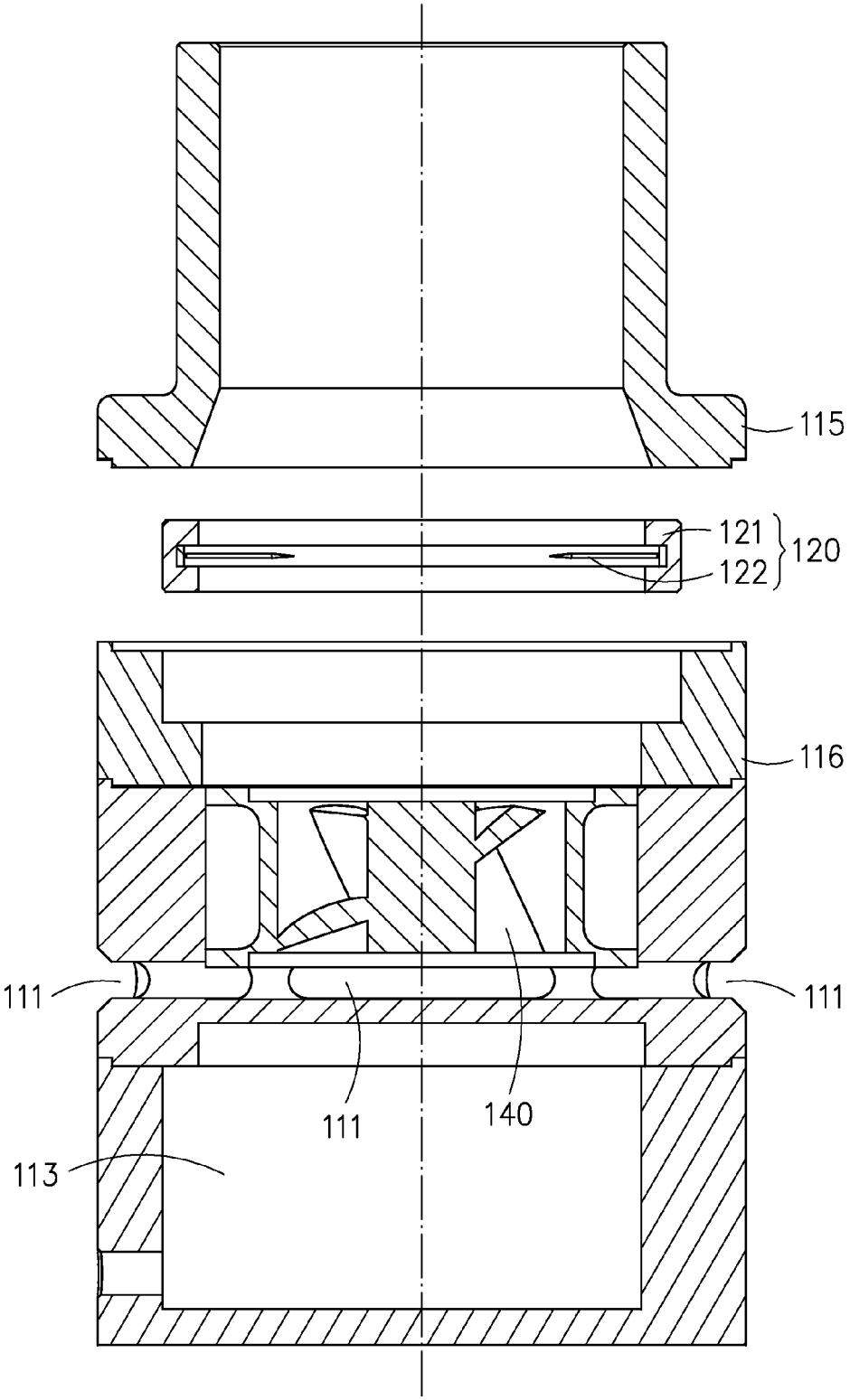
FIG. 4 is an exploded view showing a lower portion of FIG. 2.
Figure 5:
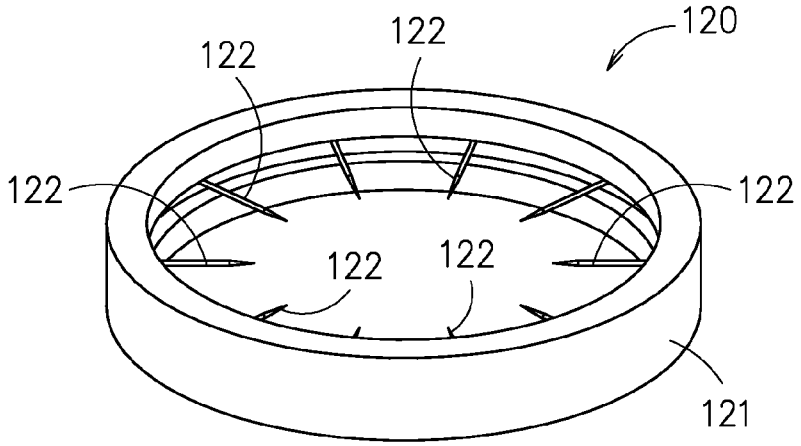
FIG. 5 is a schematic perspective view of the corona discharged module of the embodiment of FIG. 1.
Figure 6:
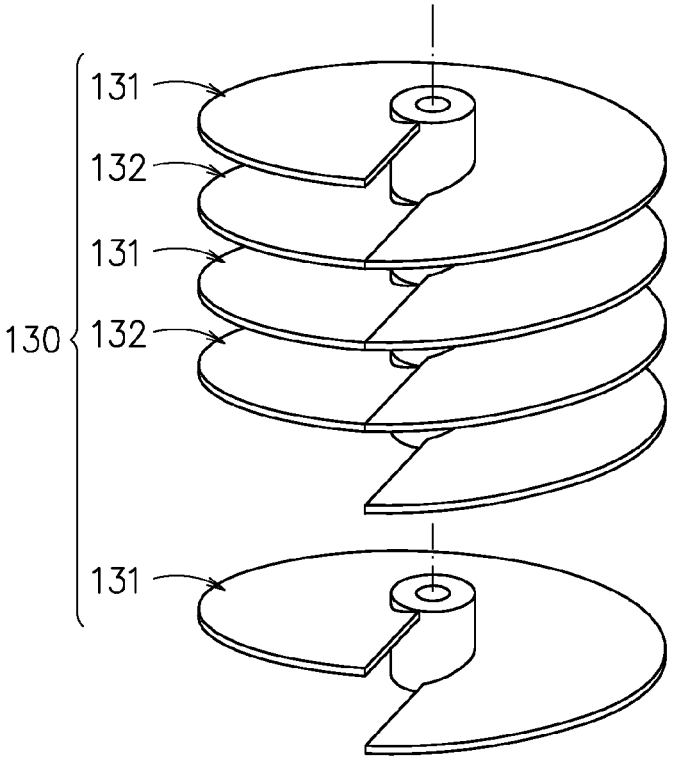
FIG. 6 is a schematic perspective view of the collector module of the embodiment of FIG. 1.

Referring now to FIG. 2 through FIG. 5, the corona discharged module 120 includes a seat 121 and a plurality of ionizing units 122 discretely disposed on the seat 121. The seat 121 is formed as a ring, and the ionizing units 122 are arranged separately at an inner rim of the ring in a manner of having a tapered end of each the ionizing unit 122 to protrude inward and toward a center of the ring. Each of the plurality of ionizing units 122 can produce point discharges with a first polarity, which is positive charged or negative charged. In the present embodiment, the plurality of ionizing units 122 can be made of a conductive material such as a metal, a graphic or a carbon brush. In the present embodiment, the corona discharged module 120 is disposed between an upper sub-body 115 and a lower sub-body 116, as shown in FIG. 2 or FIG. 4.

Please refer to FIG. 2, FIG. 3, FIG. 4 and FIG. 6, the collector module 130 includes a plurality of first collector units 131 and a plurality of second collector units 132, which are disposed along a central axis in an alternative manner. Each of the first collector units 131 has at least one first collector blade 1311 formed as a helix structure, and also each of the second collector units 132 has at least one second collector blade 1321 formed as another helix structure. The first collector units 131 and the second collector units 132 are alternately disposed on a shaft 133 so that the first collector blades 1311 and the second collector blades 1321 can form a continuous spiral passage around the shaft 133, which is a part of the air flow passage.

In the present embodiment, the collector module 130 is uncharged or charged with a second polarity different from the first polarity. The collector module 130 can be made of a conductive metal if it is charged with the second polarity. However, if the collector module 130 is uncharged, it can be made of plastic or polymer such as PP, PE, PVC or PC.

In another embodiment, the second collector unit 132 can be charged with a second polarity different from the first polarity of the ionizing units 122, and the first collector unit 131 is uncharged or charged with the same polarity (i.e. the second polarity) as the second collector unit 132. For example, when the ionizing units 122 are positively charged, the second collector unit 132 is negatively charged and the first collector unit 131 is uncharged or positively charged correspondingly. For another example, when the ionizing units 122 are negatively charged, the second collector unit 132 is positively charged, and the first collector unit 131 is uncharged or negatively charged correspondingly.

Figure 7:
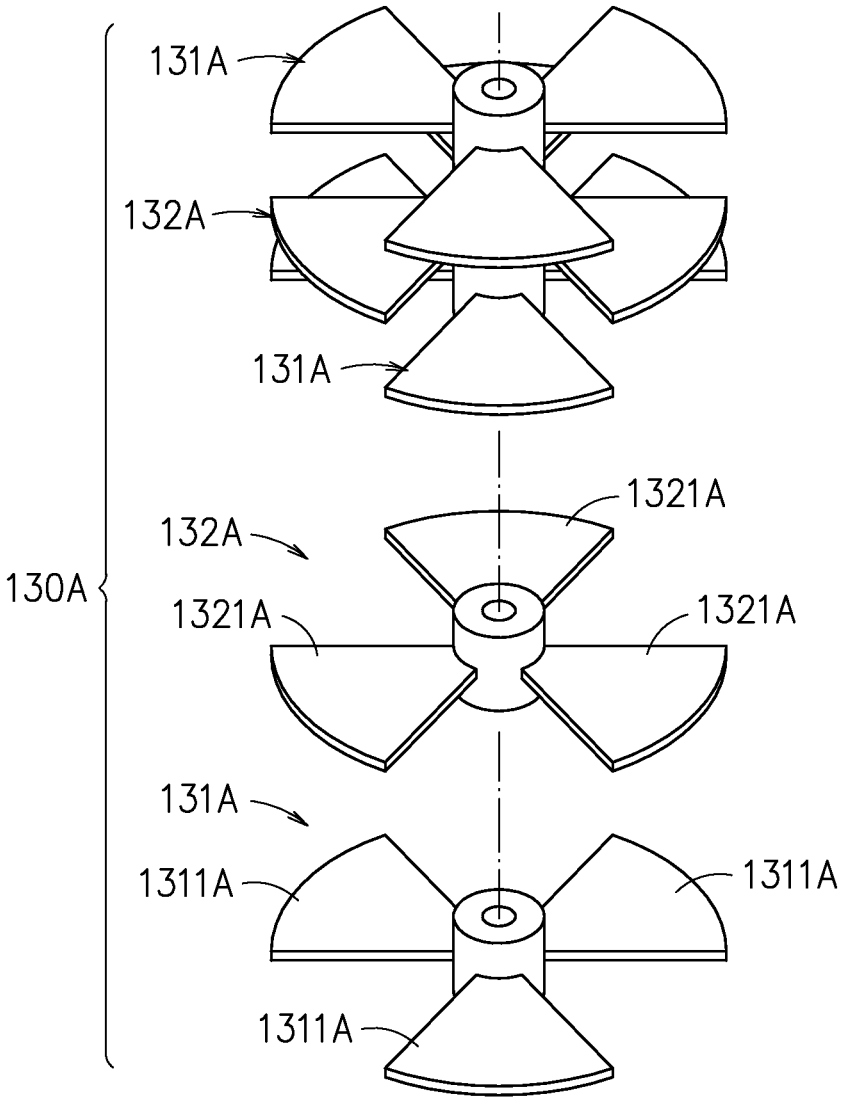
FIG. 7 is a schematic perspective view of another embodiment of the collector module according to the present disclosure.

In another embodiment shown in FIG. 7, the collector module 130A includes a plurality of first collector units 131A and a plurality of second collector units 132A, which are alternately and co-axially disposed to each other. Each of the first collector units 131 has at least one first collector blade 1311A in a fan shape, and each of the second collector units 132 has at least one second collector blade 1321A in another fan shape. In the present embodiment, the first collector unit 131A and the second collector unit 132A are in the same shape. By taking the first collector unit 131A for example, there is spacing between two adjacent first collector blades 1311A for flowing therethrough the air stream. The area ratio of the spacing to the corresponding cross section is between 0.3-0.8. The second collector unit 132A is arranged in a similar way to the first collector unit 131A.

The plurality of the first collector units 131A and the plurality of the second collector units 132A are alternately disposed along the shaft 133 as shown in FIG. 7 for example, so that the first collector blades 1311A and the second collector blades 1321A can be integrated to form a part of the air flow passage. In one embodiment, the first collector blades 1311A and the second collector blades 1321A can be disposed by crossing each other in a regular up-and-down manner as shown in FIG. 7. In another embodiment, the first collector blades 1311A and the second collector blades 1321A can be disposed by crossing each other in an irregular up-and-down manner. In still another embodiment, the first collector blades 1311A and the second collector blades 1321A can be formed in different shapes.

Figure 8:
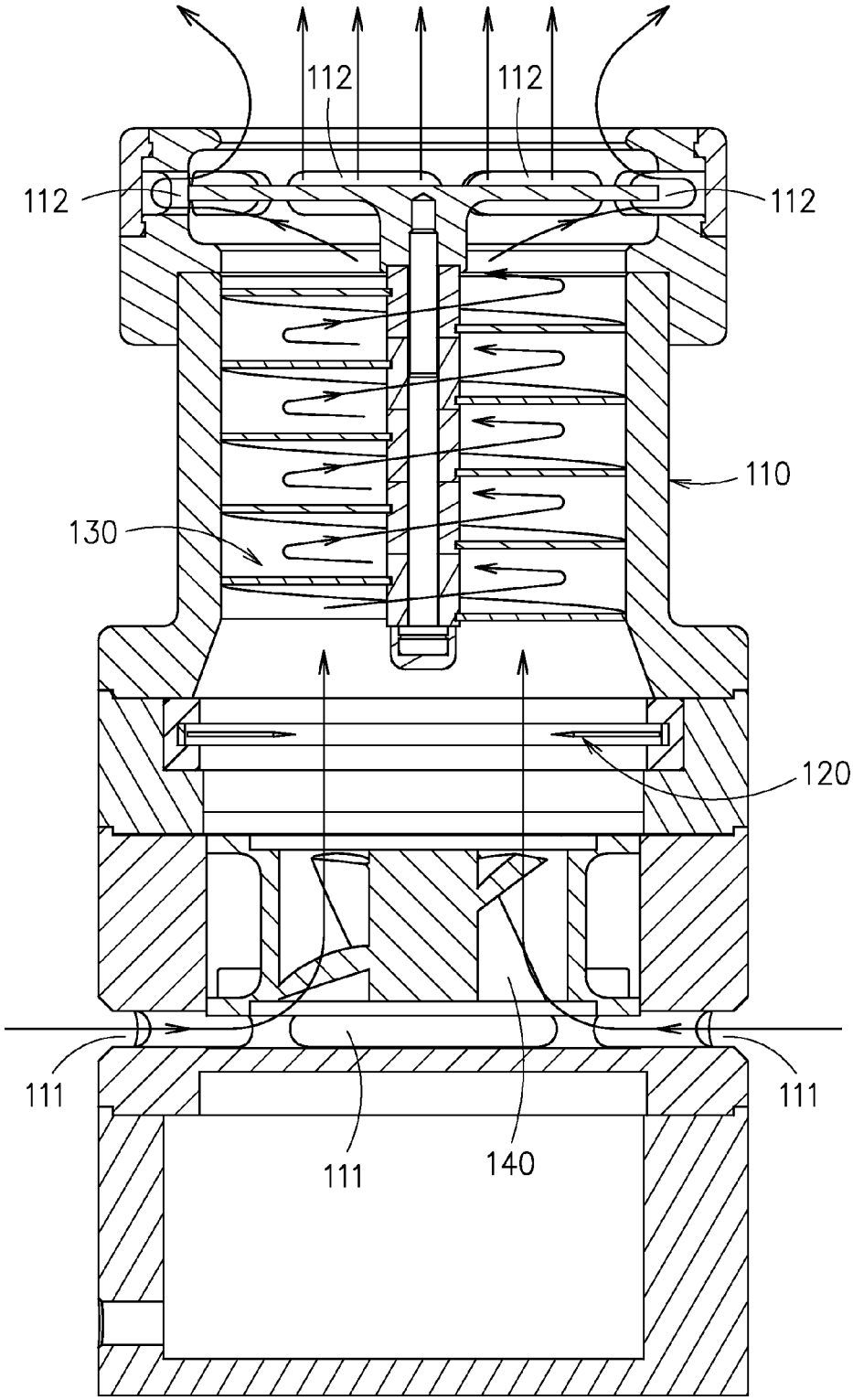
FIG. 8 is a schematic view showing a flowing path of the air stream of the electrostatic air cleaner of FIG. 2.

Referring now to FIG. 8, a flowing path of an air stream symbolized by arrow lines inside and outside the cleaner according to an embodiment of the present disclosure is schematically shown. Operationally, the fan 140 draws the air stream from the inlet 111 into the main body 110. Particles in the air stream would be electrically charged by the electric field of the corona discharged module 120 when the air stream passes through the corona discharged module 120. The charged particles are then attracted and adhere to a surface of the collector module 130. Namely, the particles in the air stream are captured and collected in an electrostatic manner by the collector module 130 inside the main body 110 after being charged by the preceding corona discharged module 120. Then, the purified air is discharged out of the main body 110 from the outlet 112.

Figure 9:
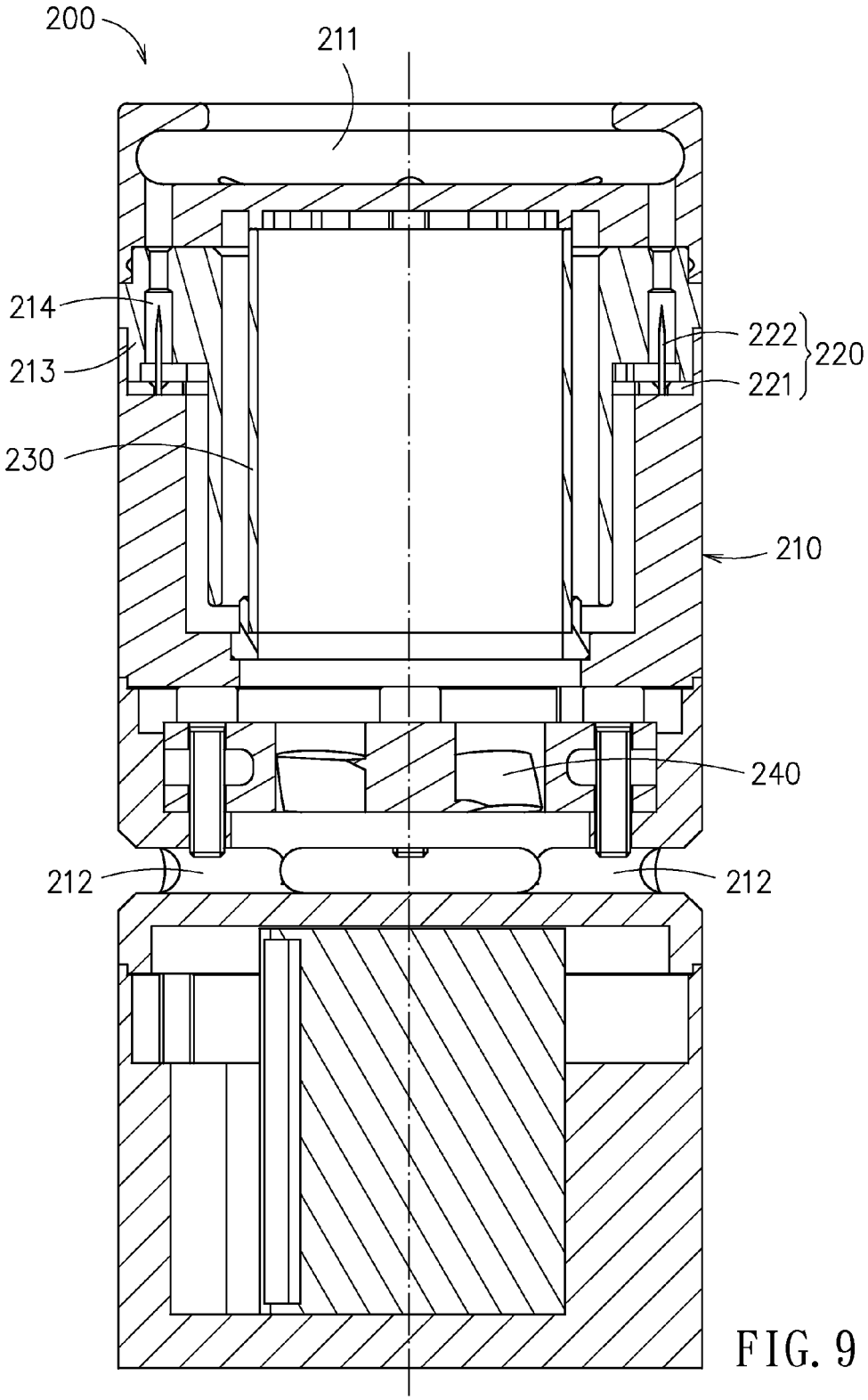
FIG. 9 is a schematic cross-sectional view of another embodiment of the electrostatic air cleaner according to the present disclosure.

Refer to FIG. 9, in which another embodiment of the electrostatic air cleaner according to the present disclosure is shown. The corona discharged module 220 disposed outside the collector module 230 includes a seat 221 and a plurality of ionizing units 222 disposed on the seat 221 in a predetermined discrete manner. The ionizing units 222 are parallel spaced on the seat 221, and a tapered end of each ionizing unit 222 directs in the same direction, preferably in a vertical-up direction as shown in FIG. 9. In the present embodiment as shown in FIG. 9, only two ionizing units 222 are shown in the corresponding cross-sectional drawing.

However, it shall be understood that the quantity of the ionizing units 222 is not limited to two and can be set upon demands.

Similarly, each of the ionizing units 222 can produce point discharges with a first polarity, either positively or negatively charged. The main body 210 has an inlet 211 and an outlet 212. In this embodiment, the inlet 211 is disposed at the upper section of the main body 210 with the outlet 212 to be disposed therebeneath. The inlet 211 and the outlet 212 are communicative in space so as to form an air flow passage inside the main body 210. In the present embodiment, the fan 240 is disposed by closing to the outlet 212.

In the embodiment shown in FIG. 9, the main body 210 includes a wall 213 having a thickness able to include a space 214 for forming a part of the air flow passage. The plurality of ionizing units 222 are parallel spaced within the space 214, and the tapered end of each ionizing unit 222 is directed toward the upstream of the flowing path of the air stream.

In the present embodiment, the collector module 230 can be a hollow cylinder uncharged with a second polarity different from the first polarity of the plurality of ionizing units 222. Similarly, when the collector module 230 is charged with the second polarity, it can be made of a conductive metal. On the other hand, when the collector module 230 is uncharged, it can be made of plastics or polymer such as PP, PE, PVC or PC.

Figure 10:
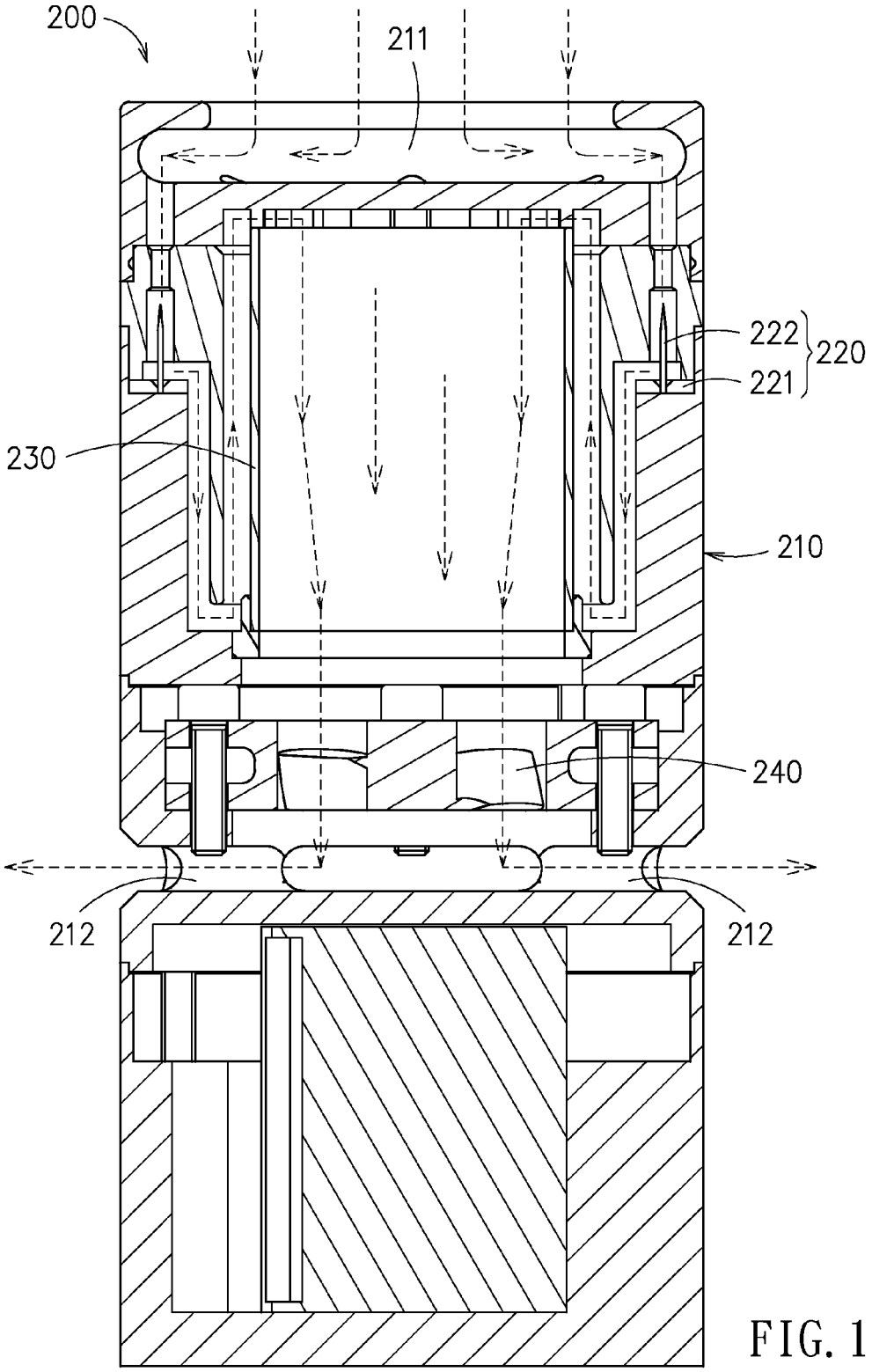
FIG. 10 is a schematic view showing a flowing path of the air stream of the electrostatic air cleaner of FIG. 9.

Please further refer to FIG. 10, in which a flowing path of the air stream according to an embodiment of the present disclosure is schematically shown. Operationally, the fan 240 draws the air stream from the inlet 211 into the main body 210. Particles in the air stream would be electrically charged by the electric field of the corona discharged module 220 when the air stream passes through the corona discharged module 220. The charged particles are then attracted and adhere to the surface of the collector module 230, by which the object of capturing and collecting particles in the air stream flowing through the main body 110 is thus achieved. Then, the purified air is discharged from the outlet 212.

Figure 11:
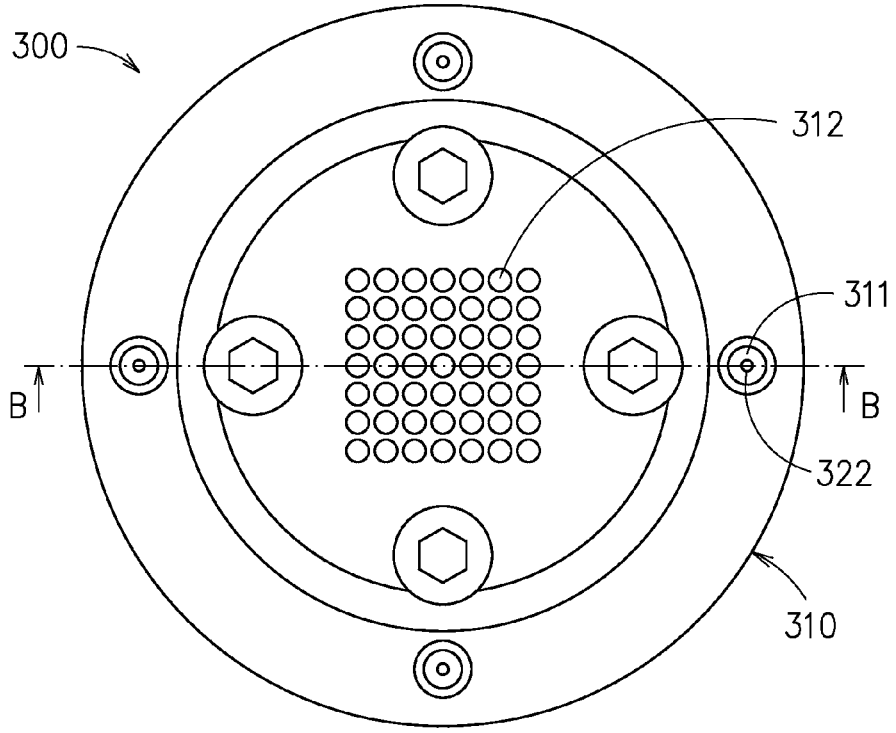
FIG. 11 is a schematic top view of a further embodiment of the electrostatic air cleaner according to the present disclosure.
Figure 12:
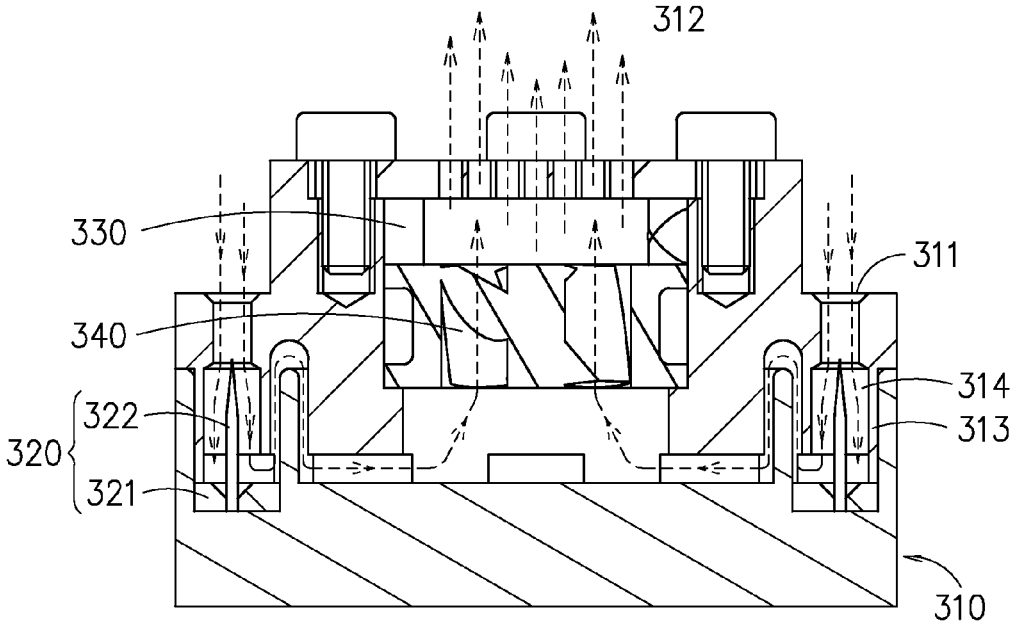
FIG. 12 is a schematic cross-sectional view of FIG. 11 along line B-B.

Referring now to FIG. 11 and FIG. 12, another embodiment of the electrostatic air cleaner according to the present disclosure is schematically shown in a top-view and a cross-sectional view along line B-B of FIG. 11, respectively. In the present embodiment, the electrostatic air cleaner 300 comprises a main body 310, a corona discharged module 320, a collector module 330 and a fan 340. The corona discharged module 320 includes a seat 321 and a plurality of ionizing units 322 separately disposed on the seat 321. The main body 310 has an inlet 311 and an outlet 312. In this embodiment, the inlet 311 and the outlet 312 are both disposed at the upper section of the main body 310, with the outlet 112 being located above the inlet 311.

In the present embodiment, the ionizing units 322 are parallel spaced to each other on the seat 321, and a tapered end formed on each ionizing unit 322 is directed toward the upstream of a flowing path of the air stream. Operationally, the fan 340 draws the air stream into the main body 310 from the inlet 311. The air stream then passes through the corona discharged module 320 and the collector module 330 in a sequence to remove the particles, and finally the purified air is discharged out of the main body 310 from the outlet 312.

In various embodiments mentioned above, one common feature among many merits of the present disclosure is to form the air flow passage inside the main body so as to dispose thereinside in a sequential order the corona discharged module, the collector module and the fan. Moreover, while the fan draws the air stream into the air flow passage, the air stream passes through the corona discharged module and the collector module in a sequence of charging and then removing the particles in the air flow, and the purified air is discharged from the outlet thereafter. It is noted that the inlet and the outlet can be disposed at relative altitude at will in the main body of the present disclosure, and thus is not limited by the present embodiment. In addition, features of the air flow passage, the corona module and the collect module are given by way of illustration only, not for limiting scopes of the present disclosure.

Figure 13:
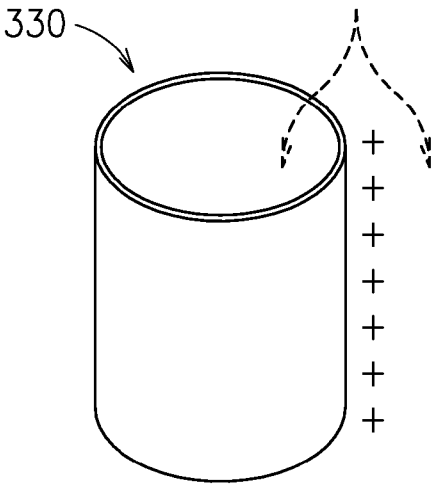
FIG. 13 and FIG. 14 demonstrate schematically two embodiments of the collector module according to the present disclosure.
Figure 14:
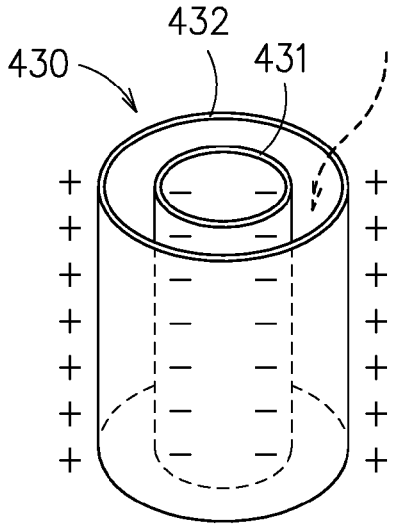
Figure 15:
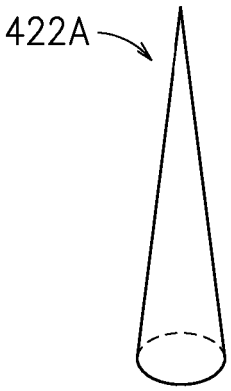
FIG. 15 to FIG. 20 demonstrate schematically different embodiments of the ionizing unit according to the present disclosure.
Figure 16:
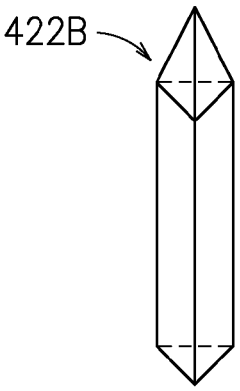
Figure 17:
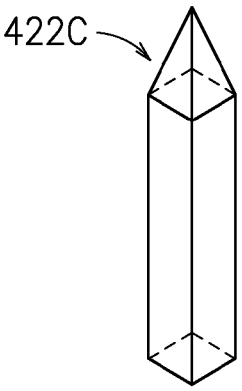
Figure 18:
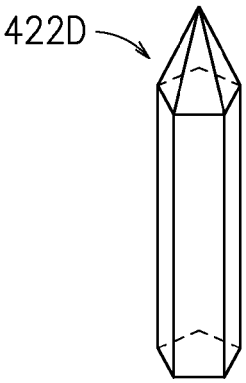
Figure 19:
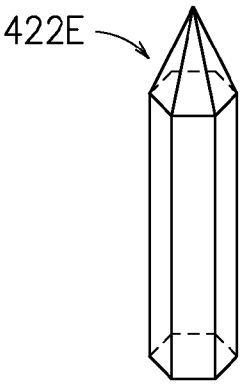

Please refer to FIG. 13 and FIG. 14, in which two more different embodiments of the collector module according to the present disclosure are shown, respectively. As shown in FIG. 13, the collector module 330 is a hollow cylinder positively charged or uncharged, and the air stream is drawn to pass through the hollow cylinder 330 as the dashed arrow lines as illustrated.

On the other hand, as shown in FIG. 14, the collector module 430 is composed of a pair of sleeving hollow cylinders, in which one cylinder 431 is negatively charged and the other cylinder 432 is positively charged or uncharged. In the embodiment of FIG. 14, the air stream is drawn to pass through the spacing between the sleeving hollow cylinders 431 and 432.

Figure 20:
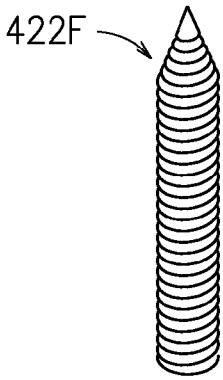

Please refer to FIG. 15 to FIG. 20, in which various embodiments for the ionizing units according to the present disclosure are individually shown. As shown in FIG. 15 to FIG. 19, each of the ionizing units 422A, 422B, 422C, 422D and 422E has an individual tapered end formed at the tip thereof in a predetermined shape, such as a conical structure, a pyramidal structure or any the like. Moreover, as shown in FIG. 20, the ionizing unit 422F has its tapered end formed on a helix structure thereof.

Figure 21:
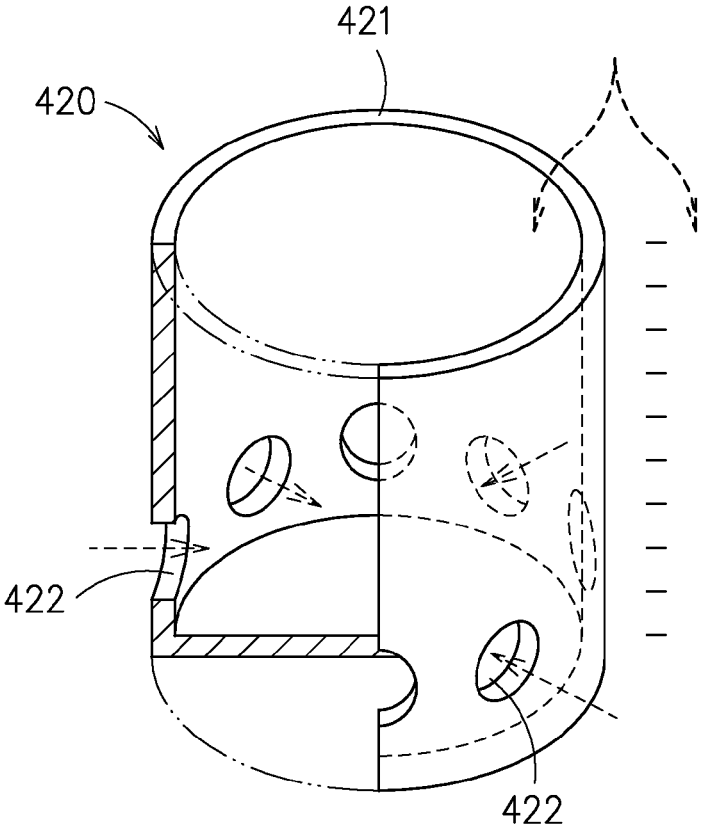
FIG. 21 is a schematic view of another embodiment of the corona discharged module according to the present disclosure.
Figure 22A:
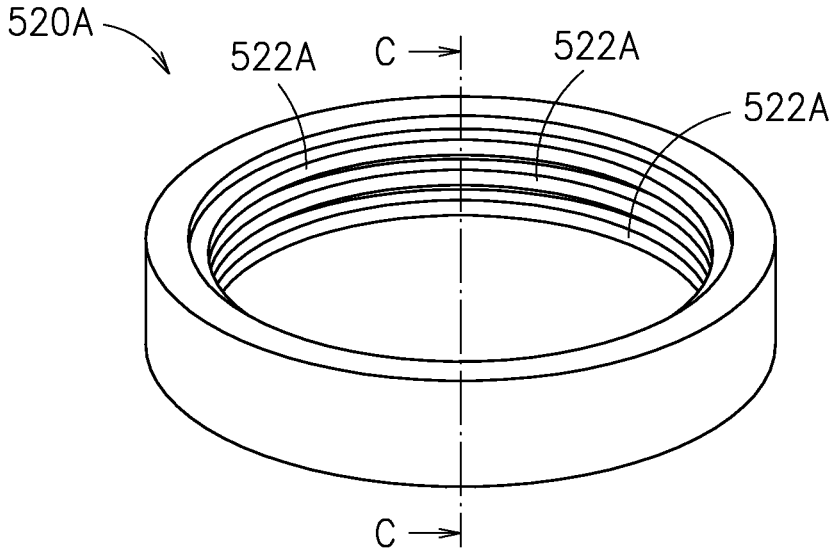
FIG. 22A and FIG. 22B present schematically a first embodiment of the corona discharged module according to the present disclosure in a perspective view and a cross-sectional view along line C-C, respectively.
Figure 22B:
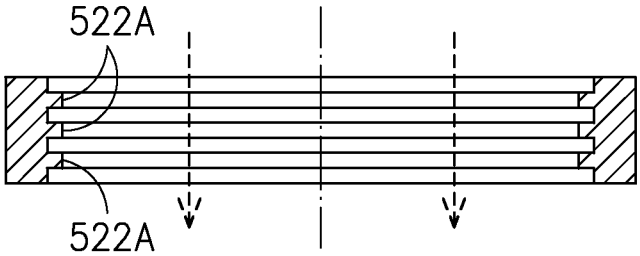
Figure 23A:
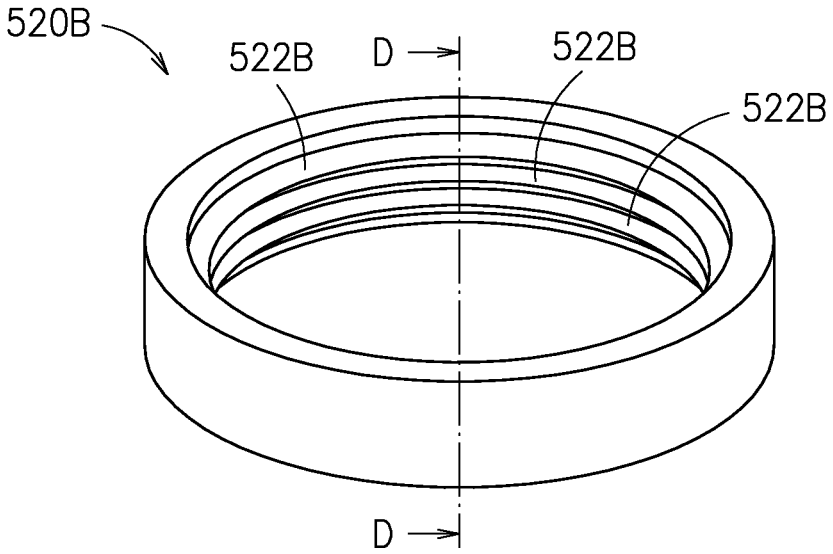
FIG. 23A and FIG. 23B present schematically another embodiment of the corona discharged module according to the present disclosure in a perspective view and its cross-sectional view along line D-D, respectively.
Figure 23B:
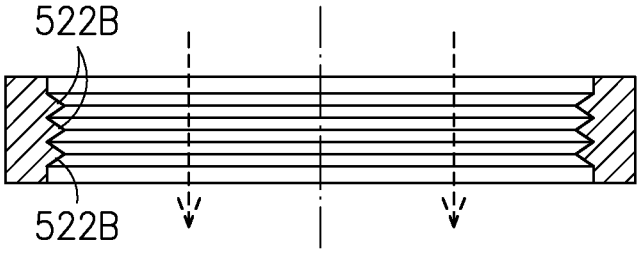
Figure 24A:
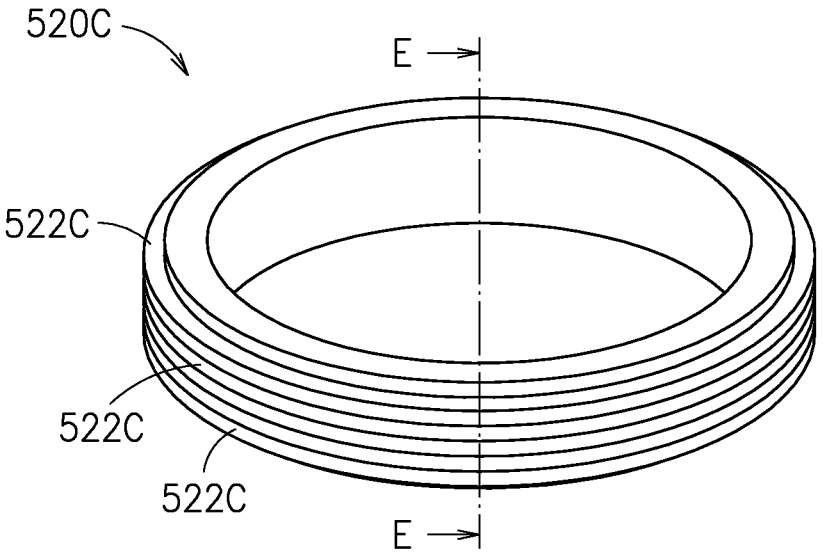
FIG. 24A and FIG. 24B present schematically a further embodiment of the corona discharged module according to the present disclosure in a perspective view and its cross-sectional view along line E-E, respectively.
Figure 24B:
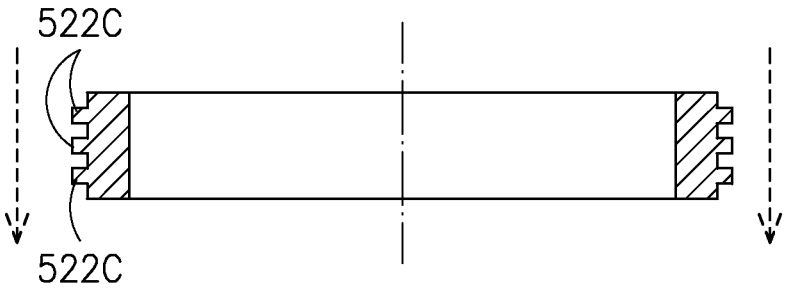
Figure 25A:
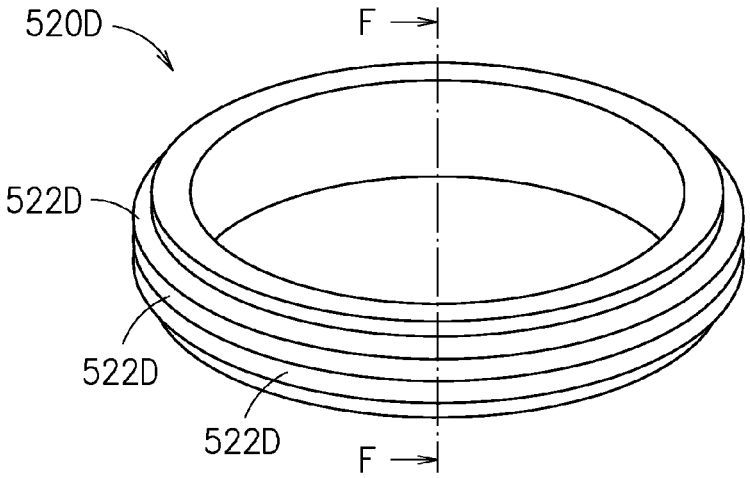
FIG. 25A and FIG. 25B present schematically one more embodiment of the corona discharged module according to the present disclosure in a perspective view and its cross-sectional view along line F-F, respectively.
Figure 25B:
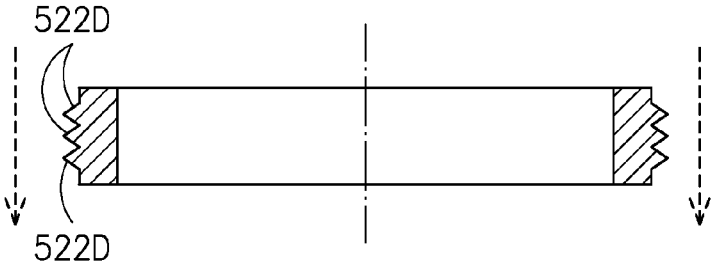
Figure 26:
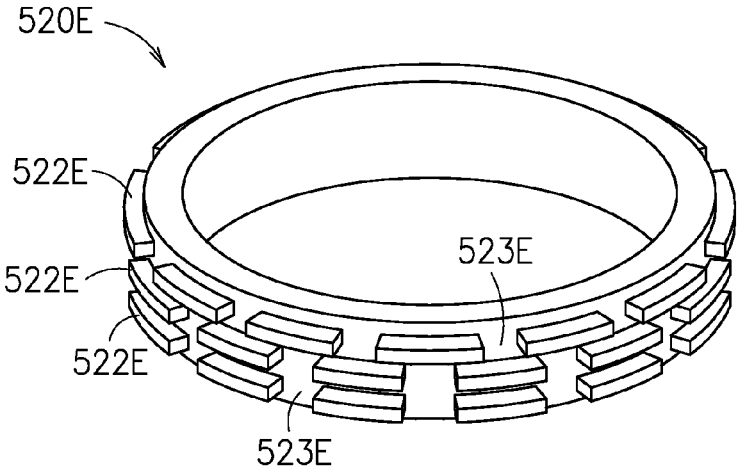
FIG. 26 is a schematic perspective view of another one more embodiment of the corona discharged module according to the present disclosure.

Please refer to FIG. 21, in which another embodiment of the corona discharged module according to the present disclosure is schematically shown. The corona discharged module 420 is formed as a hollow cylinder including a cylindrical wall acting as the ionizing unit, and an axial edge 421 of the hollow cylinder is directed toward the upstream of a flowing path of the air stream symbolized by dashed arrow lines. The cylindrical wall of the hollow cylinder includes a plurality of through holes 422 for the air stream to pass through, and the area ratio of the plurality of through holes to the wall is between 0.3-0.8 or between 0.01-0.5.

Please refer to FIG. 22A to FIG. 26, in which various embodiments of the corona discharged module according to the present disclosure are shown. Each embodiment of the corona discharged modules 520A to 520E is formed as a ring-shaped cylinder including a wall having a protrusion part acting as an ionizing unit, and the protrusion part is protruded into the air flow passage. The flowing path of the air stream is shown by dashed arrow lines in FIG. 22A to FIG. 26, and the corresponding protrusion part is formed as annular protrusions 522A, 522B, 522C, 522D or 522E, respectively.

As shown in FIGS. 22B, 23B, 24B and 25B, each of the ionizing units includes an end directing toward a center line of the air flow passage, and the end comprises at least a peak. In the particular embodiment shown in FIG. 26, each of the plurality of annular protrusions 522E has at least one discontinuous section 523E, and the discontinuous sections 523E can be aligned or misaligned to one another. In still another embodiment not shown herein, the protrusion part can include a spiral protrusion.

It is noted that each of the embodiments of the collect module, the ionizing unit and the corona module mentioned above can be applied to each of the electrostatic air cleaner shown in FIG. 8, FIG. 10 or FIG. 11.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. An electrostatic air cleaner, comprising:

a main body, including an air flow passage;

a corona discharge module for producing point discharges with a first polarity;

a collector module; and a fan for drawing an air stream into the air flow passage;

wherein the corona discharge module, the collector module and the fan are disposed in the air flow passage, particles in the air stream are electrically charged by an electric field of the corona discharge module while the air stream passes through the corona discharge module, and the particles charged by the corona discharge module are then captured by the collector module;

wherein the collector module includes a first collector unit having at least one first collector blade, and a second collector unit having at least one second collector blade, wherein the at least one first collector unit and the at least one second collector unit are alternately disposed so as to form a part of the air flow passage between the at least one first collector blade and the at least one second collector blade;

wherein the first collector unit includes a plurality of the first collector blades in a fan shape with spacing existing between adjacent two of the plurality of first collector blades; and wherein the first collector blade and the second collector blade are formed as a helix structure, and the first collector unit and the second collector unit are arranged so that the at least one first collector blade and the at least one second collector blade form a continuous spiral passage as a part of the air flow passage.

2. The electrostatic air cleaner of claim 1, wherein the collector module is charged with a second polarity different from the first polarity.

3. The electrostatic air cleaner of claim 1, wherein the collector module is uncharged.

4. The electrostatic air cleaner of claim 1, wherein the first collector unit is uncharged and the second collector unit is charged with a second polarity which is different from the first polarity.

5. The electrostatic air cleaner of claim 1, wherein the first collector unit is not charged with the first polarity and the second collector unit is charged with a second polarity which is different from the first polarity.

6. The electrostatic air cleaner of claim 1, wherein an area ratio of the spacing to a cross section of the first collector unit is ranged between 0.3-0.8.

7. An electrostatic air cleaner, comprising:

a main body, including an air flow passage;

a corona discharge module for producing point discharges with a first polarity;

a collector module, wherein the collector module is formed as a hollow cylinder, and a fan for drawing an air stream into the air flow passage;

wherein the corona discharge module, the collector module and the fan are disposed in the air flow passage, particles in the air stream are electrically charged by an electric field of the corona discharge module while the air stream passes through the corona discharge module, and the particles charged by the corona discharge module are then captured by the collector module; and wherein the corona discharge module is shaped as a hollow cylinder including a wall acting as an ionizing unit, the air stream is drawn into the hollow cylinder, the wall of the hollow cylinder includes a plurality of through holes for the air stream to pass through, and an area ratio of the plurality of through holes to the wall is between 0.3-0.8.

8. The electrostatic air cleaner of claim 7, wherein the collector module is composed of a pair of sleeving hollow cylinders, one thereof being negatively charged while another is positively charged or uncharged, the air stream being drawn to pass through spacing between the sleeving hollow cylinders.

9. The electrostatic air cleaner of claim 1, wherein the corona discharge module includes a seat and a plurality of ionizing units separately disposed on the seat.

10. The electrostatic air cleaner of claim 9, wherein the seat is formed as a ring and the ionizing units are arranged on an inner circle of the ring, a tapered end formed on each of the ionizing units being directed toward a center of the ring.

11. The electrostatic air cleaner of claim 9, wherein the ionizing units are parallel spaced on the seat, and a tapered end formed on each of the ionizing units is directed toward a same direction.

12. The electrostatic air cleaner of claim 1, wherein the main body includes a wall, and the corona discharge module includes a plurality of ionizing units having individual tapered ends and being disposed within the wall.

13. The electrostatic air cleaner of claim 12, wherein the ionizing units are parallel spaced within the wall of the main body, and the tapered ends are directed toward an upstream of a flowing path of the air stream.

14. The electrostatic air cleaner of claim 1, wherein the corona discharge module is shaped as a hollow cylinder including a wall acting as an ionizing unit, and the air stream is drawn into the hollow cylinder.

15. The electrostatic air cleaner of claim 14, wherein the wall of the hollow cylinder includes a plurality of through holes for the air stream to pass through, and an area ratio of the plurality of through holes to the wall is between 0.3-0.8.

16. The electrostatic air cleaner of claim 1, wherein the corona discharge module is formed as a ring-shaped cylinder including a wall having a protrusion part acting as an ionizing unit, and the protrusion part protrudes into the air flow passage.

17. The electrostatic air cleaner of claim 16, wherein the ionizing unit includes an end directing toward the air flow passage, and the end includes at least a peak.

18. The electrostatic air cleaner of claim 16, wherein the protrusion part includes a plurality of annular protrusions.

19. The electrostatic air cleaner of claim 17, wherein the protrusion part includes a plurality of annular protrusions.

20. The electrostatic air cleaner of claim 18, wherein the annular protrusions comprise a plurality of discontinuous sections, each of the plurality of annular protrusions has at least one of the discontinuous-sections, and the discontinuous sections are aligned or misaligned to one another.

21. The electrostatic air cleaner of claim 16, wherein the protrusion part includes a spiral protrusion.

22. The electrostatic air cleaner of claim 17, wherein the protrusion part includes a spiral protrusion.

23. The electrostatic air cleaner of claim 14, wherein the wall of the hollow cylinder includes a plurality of through holes for the air stream to pass through, and an area ratio of the plurality of through holes to the wall is between 0.01-0.5.

24. The electrostatic air cleaner of claim 19, wherein the annular protrusions comprise a plurality of discontinuous sections, each of the plurality of annular protrusions has at least one of the discontinuous sections, and the discontinuous sections are aligned or misaligned to one another.

25. The electrostatic air cleaner of claim 7, wherein the corona discharge module includes a seat and a plurality of ionizing units separately disposed on the seat.

26. The electrostatic air cleaner of claim 25, wherein the seat is formed as a ring and the ionizing units are arranged on an inner circle of the ring, a tapered end formed on each of the ionizing units being directed toward a center of the ring.

27. The electrostatic air cleaner of claim 25, wherein the ionizing units are parallel spaced on the seat, and a tapered end formed on each of the ionizing units is directed toward a same direction.

28. The electrostatic air cleaner of claim 7, wherein the main body includes a wall, and the corona discharge module includes a plurality of ionizing units having individual tapered ends, wherein the ionizing units are disposed within the wall.

29. The electrostatic air cleaner of claim 28, wherein the ionizing units are parallel spaced within the wall of the main body, and the tapered ends are directed toward an upstream of a flowing path of the air stream.

30. An electrostatic air cleaner, comprising:

a main body, including an air flow passage;

a corona discharge module for producing point discharges with a first polarity;

a collector module, wherein the collector module is formed as a hollow cylinder, and a fan for drawing an air stream into the air flow passage;

wherein the corona discharge module, the collector module and the fan are disposed in the air flow passage, particles in the air stream are electrically charged by an electric field of the corona discharge module while the air stream passes through the corona discharge module, and the particles charged by the corona discharge module are then captured by the collector module; and wherein the corona discharge module is shaped as a hollow cylinder including a wall acting as an ionizing unit, the air stream is drawn into the hollow cylinder, the wall of the hollow cylinder includes a plurality of through holes for the air stream to pass through, and an area ratio of the plurality of through holes to the wall is between 0.01-0.5.

31. The electrostatic air cleaner of claim 7, wherein the corona discharge module is formed as a ring-shaped cylinder including a wall having a protrusion part acting as an ionizing unit, and the protrusion part protrudes into the air flow passage.

32. The electrostatic air cleaner of claim 31, wherein the ionizing unit includes an end directing toward the air flow passage, and the end includes at least a peak.

33. The electrostatic air cleaner of claim 31, wherein the protrusion part includes a plurality of annular protrusions.

34. The electrostatic air cleaner of claim 33, wherein the annular protrusions comprise a plurality of discontinuous sections, each of the plurality of annular protrusions has at least one of the discontinuous sections, and the discontinuous sections are aligned or misaligned to one another.

35. The electrostatic air cleaner of claim 32, wherein the protrusion part includes a plurality of annular protrusions.

36. The electrostatic air cleaner of claim 35, wherein the annular protrusions comprise a plurality of discontinuous sections, each of the plurality of annular protrusions has at least one of the discontinuous sections, and the discontinuous sections are aligned or misaligned to one another.

37. The electrostatic air cleaner of claim 31, wherein the protrusion part includes a spiral protrusion.

38. The electrostatic air cleaner of claim 32, wherein the protrusion part includes a spiral protrusion.

* * * * *